United States Patent [19]

Reed

[11] 4,141,663

[45] Feb. 27, 1979

[54] JAM-RESISTANT LEAD FEED MECHANISM FOR MECHANICAL PENCIL

[75] Inventor: David F. Reed, Kansas City, Mo.

[73] Assignee: Hallmark Cards, Incorporated, Kansas City, Mo.

[21] Appl. No.: 774,939

[22] Filed: Mar. 7, 1977

[51] Int. Cl.[2] ..... B43K 24/06

[52] U.S. Cl. ..... 401/68; 401/77

[58] Field of Search ..... 49/55, 58, 68, 75–78, 49/86–87

[56] References Cited

U.S. PATENT DOCUMENTS

| | | | |
|---|---|---|---|
| 2,023,865 | 12/1935 | Weaver et al. | 401/75 X |
| 2,523,568 | 9/1950 | Halverson | 401/55 X |
| 2,573,325 | 10/1951 | Fowlie | 401/75 X |
| 3,492,077 | 1/1970 | Tessier | 401/86 |
| 3,630,628 | 12/1971 | Roman | 401/68 |
| 3,804,536 | 4/1974 | Torii et al. | 401/58 |
| 3,917,418 | 11/1975 | Lanoie | 401/78 X |

*Primary Examiner*—Edward M. Coven

*Attorney, Agent, or Firm*—Schmidt, Johnson, Hovey & Williams

[57] ABSTRACT

An improved, jam-resistant, relatively low cost pencil mechanism is provided which includes an annular resilient member disposed about the nose bushing of the mechanism for securely locking the bushing and lead guide connected thereto in place within the pencil barrel, while at the same time allowing the pencil tip and lead guide to be threadably interconnected without creating open thread discontinuities along the length of the lead path. The resilient member serves to take up any dimensional irregularities in the pencil mechanism components and allow full threaded interlocking of the pencil tip and lead guide so that no exposed threads are present along the lead path, which can cause jamming of the mechanism if the pencil lead becomes broken within the guide. In preferred forms, the resilient member is of annular, tapered configuration permitting telescopic positioning thereof within the pencil barrel without disruption or axial roll-up of the member.

6 Claims, 6 Drawing Figures

JAM-RESISTANT LEAD FEED MECHANISM FOR MECHANICAL PENCIL

This invention relates to a relatively inexpensive, jam-resistant operating mechanism for a mechanical pencil which is specially constructed to minimize jamming problems caused by lead breakage in the mechanism. More particularly, it is concerned with a pencil mechanism which includes an annular, tapered, resilient member disposed about the nose bushing of the mechanism for locking the bushing in place within the outer pencil barrel and allowing full threaded interconnection of the pencil tip and lead guide without creation of discontinuities in the form of open or exposed threads along the length of the lead path.

A wide variety of operating mechanisms for mechanical pencils have been proposed in the past. One type of mechanism which has achieved considerable commercial success employs an elongated, tubular, axially slotted lead guide which is received and secured to a bored nose bushing. The latter has a threaded projection which is received within a complemental bore provided in the pencil tip. An elongated lead gripper is disposed within the lead guide and has an outwardly extending protrusion extending through the guide slot. A rotatable spiral is telescoped over the lead guide in order to move the lead gripper within the guide. Rotation of a spiral thus serves to advance or retract a lead gripper within the lead guide, along with a lead segment.

Notwithstanding the commercial success of such prior operating mechanisms, a number of problems remain. Specifically, in most cases the lead path cooperatively defined by the pencil tip, nose bushing and lead guide presents an area of discontinuity at the area of the threaded connection between the tip and bushing. This stems from the fact that the nose bushing surrounding the lead guide is configured to engage the adjacent pencil barrel during assembly of the pencil; and this engagement often prevents complete, full-threaded interconnection of the nose bushing and tip, with the result that an open threaded section is presented along the length of the lead path. Of course, while it would be possible to carefully machine the components of the pencil mechanism to achieve a full-threaded connection between the tip and nose bushing, and simultaneous engagement between the latter and the surrounding pencil barrel, the cost of such an expedient would be prohibitive.

Although in the open thread discontinuity described above presents no problems during normal pencil operations, in the event that the lead segment within the mechanism becomes broken or shattered (as for example when the pencil is dropped), lead fragments can become lodged in the open threaded area, thus making it difficult or impossible to continue advancement of the lead segment. In such cases, it sometimes happens that users unknowingly damage or destroy the pencil mechanism by applying excess torque to the operating spiral, which of course acts in opposition to the lead blockage. This can cause the pencil mechansim to come apart in the hands of the user, or otherwise lead to severe or total destruction of the pencil mechanism.

One response to the problems described above can be found in co-pending U.S. patent application Ser. No. 691,721, filed June 1, 1976. This application describes an improved pencil mechanism presenting a substantially continuous lead path in order to minimize jamming problems. However, this construction is somewhat expensive to produce, and accordingly additional research has been undertaken to provide less costly mechanisms having desirable anti-jamming characteristics.

It is therefore the most important object of the present invention to provide operating mechanism for a mechanical pencil which has excellent jam resistance and operating characteristics, and is relatively inexpensive to fabricate and construct, so that the twin objectives of low cost and reliability in operation can be achieved.

As a corollary to the foregoing, another object of the invention is to provide a pencil mechanism which includes an annular resilient member disposed about the nose bushing of the mechanism for securely locking the bushing and lead guide connected thereto in place within the pencil barrel, while also allowing the pencil tip and lead guide to be interconnected without creation of discontinuities in the form of an open threaded region along the length of the lead path; the resilient member serves to take up any dimensional irregularities in the pencil mechanism components and allows full-threaded interlocking of the pencil tip and lead guide with complete elimination of exposed threads along the lead path.

Another object of the invention is to provide a mechanism of the type described wherein the resilient member is of annular, tapered configuration for engaging the surrounding adjacent pencil barrel without disruption or axial roll-up of the member, so that the pencil mechanism can be telescopically inserted within the barrel attached to the pencil tip without difficulty.

Figures 1, 2, 3, 4, 5, 6:
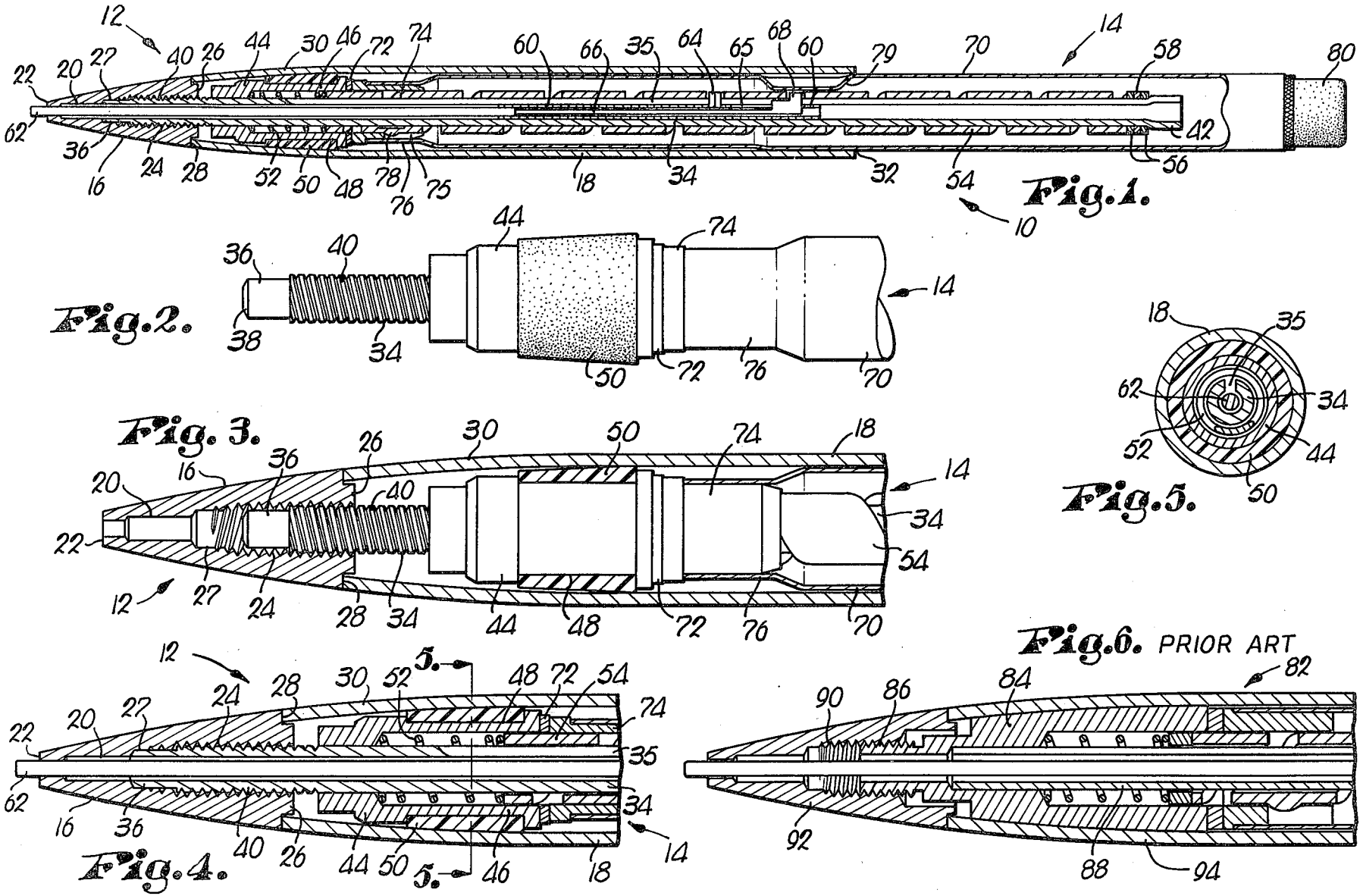
Fig. 6. PRIOR ART
FIG. 1 is a view in partial vertical section of the assembled pencil mechanism hereof, shown with a lead segment extending from the pencil tip.
FIG. 2 is an enlarged, fragmentary elevational view of the lead guide and nose bushing subassembly.
FIG. 3 is an enlarged, fragmentary sectional view illustrating the method of interconnecting the lead guide and bushing subassembly with the pencil tip and barrel.
FIG. 4 is an enlarged, fragmentary sectional view of the assembled pencil mechanism illustrating the substantially continuous lead path presented by the pencil tip and lead guide.
FIG. 5 is a vertical sectional view taken along line 5—5 of FIG. 4 and further illustrating the assembled pencil mechanism.
FIG. 6 is a fragmentary sectional view illustrating a conventional prior art pencil mechanism having an exposed thread discontinuity along the length of the lead path.

Pencil mechanism 10 broadly includes respective subassemblies 12 and 14 which are telescopically interfitted and coupled together in a manner to be described. Subassembly 12 includes a somewhat conical tip 16 and an outer tubular element or decorative barrel 18, while subassembly 14 includes the lead shifting and drive components of the mechanism.

In more detail, subassembly 12 includes the tapered, somewhat conical tip 16 having a generally axially extending bore 20 therethrough. Bore 20 extends through the lead emergence end 22 of tip 16 and is enlarged and internally threaded as at 24 adjacent the connection end 26 of the tip. An unthreaded, radially enlarged portion 27 is also provided between threaded section 24 and end 22 of the tip. Finally, an annular peripheral groove 28 is provided at connection end 26 for purposes to be described.

Barrel 18 is of elongated, generally tubular configuration, and includes a smoothly tapered end 30 which converges toward connection end 22 of tip 16. As best seen in FIGS. 1, 3 and 4, the end of barrel 18 adjacent section 30 is received within the annular groove 28 and is in abutting engagement with connection end 26. The remaining end of barrel 18 is open as at 32 to allow insertion of subassembly 14. In most cases the exterior surface of barrel 18 is decorated in a desired fashion, since this is a part of the outermost casing of the pencil.

Subassembly 14 includes an elongated, tubular, lead guide 34 having an axially extending slot 35 therein and which is adapted to be received within the tip 16. In this regard, the connection end of lead guide 34 includes a substantially cylindrical leading portion 36 which is beveled as at 38 (see FIG. 2), along with a threaded portion 40 which is adapted to be complementally received within the threaded section 24 of tip bore 20. The connection between tip 16 and guide 34 serves to align the respective bores of these elements and present an elongated lead path. The opposite end of guide 34 is radially expanded as at 42 for purposes to be made clear.

Subassembly 14 also includes a tubular, irregularly shaped nose bushing 44 which is fixedly secured to lead guide 34 adjacent the end of threaded portion 40 remote from cylindrical portion 36. Bushing 44 includes a radially enlarged midportion 46 in spaced relationship to lead guide 34, with the outer face of midportion 44 being configured to present a groove 48. A tubular, axially tapered resilient member 50 is disposed within groove 48, while a helical spring 52 is located in the space between lead guide 34 and portion 46 of bushing 44.

An axially rotatable, elongated spiral 54 is positioned about lead guide 34 with one end thereof in engagement with the end of spring 52 remote from tip 16. Spiral 54 is maintained in its operative position by means of a pair of metallic thrust washers 56 having a fiber bushing 58 therebetween (see FIG. 1). As depicted, the washer and bushing assembly bears against the radial expansion 42 of lead guide 34 in order to lock spiral 54 in place.

An elongated, generally tubular lead segment gripper 60 is telescopically received within the bore of lead guide 34 and is adapted to grip one end of an elongated lead segment 62. Gripper 60 also includes a radial protrusion 64 which extends through slot 35 of guide 34, and an axially extending slot 65. A lead eject pin 66 is telescopically received within gripper 60 and includes a radial lug 68 which extends through slot 65 and in the normal operation of mechanism 10 is spaced from protrusion 64. As best seen in FIG. 1, the protrusion 64 of gripper 60, and the lug 68 of eject pin 66, are respectively received within adjacent spacings between the convolutions of spiral 54.

An elongated, generally tubular, axially rotatable drive barrel 70 is telescopically positioned over lead guide 34 and spiral 54 in order to effect axial movement of lead segment 62 as desired. In this regard, a thrust washer 72 is located in abutting relationship to the end of nose bushing 44 remote from tip 16, and an annular collar 74 is positioned in engagement with the opposite face of the washer 72. Collar 74 includes an axial groove 75 along the length thereof as shown in FIG. 1. Drive barrel 70 includes a radially constricted connection end 76 which is secured to the outer face of collar 74 for simultaneous rotation of the barrel 70 and collar 74. In addition, a radially extending protrusion 78 provided on spiral 54 is received within the groove 75 of collar 74, so that the latter and spiral 54 are rotationally locked together. Spiral 54 is locked against axial movement between the thrust washers 56 and 72, as will be clear from a study of FIG. 1.

Barrel 70 also includes three circumferentially spaced indentations 79 at the approximate middle thereof which serve to locate and maintain spiral 54 and lead guide 34 in proper radial relationship relative to the remainder of mechanism 10. The outermost end of barrel 70 is adapted to receive a removable eraser 80 in the usual fashion.

During construction of mechanism 10, subassembly 14 is simply inserted into barrel 18 of subassembly 12, whereupon the threaded end of lead guide 34 is threaded into bore 20 of tip 16. This procedure is illustrated in FIG. 5, where it will be seen that as threaded portion 40 is threaded into section 24 of bore 20, element 50 begins to engage the inner surface of barrel 18. This continues as the threaded interconnection is completed, that is, until cylindrical section 36 bottoms out against the complementally configured section 27 of bore 20. This completed configuration is illustrated in FIG. 4 where it will be seen that lead guide 34 is fully inserted within tip 16. In this orientation, the resilient member 50 is in full engagement along the length thereof with barrel 18 and serves, along with the threaded connection, to rigidify the bushing and lead guide within the barrel. In addition, the end of barrel 18 is locked within groove 28 by means of the engagement between member 50 and the barrel, so that the entire pencil mechanism is secured in place. Moreover, it will be appreciated that the bore of lead guide 34, and bore 20 of tip 16, are located in substantial registry to cooperatively define the elongated lead path for the segment 62. It is of particular importance that the lead path presents essentially no discontinuities in the form of exposed threads along the length thereof. In this respect, provision of annular member 50 serves two purposes: to take up any dimensional irregularities in the components of mechanism 10 and permit lead guide 34 to be fully inserted into the complemental bore of tip 16; and at the same time to rigidify the nose bushing and related structure within barrel 18, so that smooth operation of the mechanism 10 is assured. It will also be apparent that the tapered configuration of member 50 allows insertion thereof within barrel 18 in a manner to avoid disruption or axial roll-up of the member.

In operation, the user simply rotates drive barrel 70 which has the effect of simultaneously rotating collar 74 and spiral 34. Nose bushing 44 and lead guide 34 remain stationary by virtue of the threaded connection between the latter and tip 16, and resilient member 50 in frictional engagement with barrel 18. In any event, as rotation of spiral 34 proceeds, protrusion 64 and lug 68 are engaged so that these elements are shifted axially along the lead path defined by guide 34 and tip 16. This has the effect of shifting lead segment 62 as desired by the user. Of course, barrel 70 can be rotated in opposite directions to alternately propel and repel the lead segment. When it becomes necessary to change the lead segment, any remaining lead in the old segment is ejected by rotating barrel 70 to move gripper 60 and eject pin 66 towards tip 16. This is continued to a point permitting removal of the remaining portions of lead segment 62, whereupon a fresh segment can be inserted and the procedure reversed.

The construction and operation of mechanism 10 provides many advantages over prior units, especially in connection with jam resistance characteristics. Referring specifically to FIG. 6, a prior art pencil mechanism 82 is illustrated. In this case a nose bushing 84 having a threaded connection end 86 is provided, with the lead guide 88 being received within the bushing 84. In this unit the leading threaded portion 86 of nose bushing 84 is inserted within the complementally threaded section 90 of pencil tip 92. However, by virtue of the fact that the outermost surface of bushing 84 is adapted to engage pencil barrel 94, it will be seen that threaded portion 86 is prevented from bottoming out against the end of the threaded section 90 of tip 92. In order to achieve this desirable bottoming out, it would be necessary to carefully machine the respective components of the mechanism 82 so that portion 86 bottoms out at the precise instant that bushing 84 comes into full engagement with barrel 94. As can be appreciated, such precision machining is expensive to the point of being prohibitive. Thus, the prior unit of necessity has a region of open threads between the connection end of the nose bushing and the tip bore. This in turn means that broken lead fragments can become lodged within the open threaded portion and lead to jamming of the overall mechanism.

It will thus be seen that the present invention provides a relatively inexpensive pencil mechanism which eliminates lead path discontinuities and thereby is substantially resistant to lead jamming; at the same time the overall mechanism has the desirable operational characteristics of conventional units.

Having thus described the invention, what is claimed as new and desired to be secured by Letters Patent is:

1. A pencil mechanism, comprising:

a tip having a lead emergence end and a connection end and a generally axial bore therethrough;

a tubular element located with one end thereof adjacent said connection end and extending generally axially therefrom, a portion of said element being tapered in a direction approaching said one end;

structure located at least in part within said element and including an axially bored lead guide having the bore thereof in substantial registry with said tip bore, the respective bores of said tip and lead guide being configured and arranged to cooperatively present a substantially smooth and uninterrupted lead path for said mechanism;

means connecting said tip and said lead guide, said connecting means comprising corresponding threads on said tip bore and one end of said lead guide, said one end of the guide being threaded into said tip bore, means for rigidifying said structure within said element including a resilient member mounted on said structure and in engagement with said tapered portion of the element whereby to hold said structure stationary relative to said element and to bias said one end of the element against said tip, while at the same time permitting said corresponding threads to be fully mated such that no discontinuities are present along said path at the interface between said tip and said lead guide; and means for moving a lead segment along the length of said path as desired.

2. The pencil mechanism as set forth in claim 1 wherein said member is of annular configuration for continuous contact with said structure and the tapered portion of said element.

3. The pencil mechanism as set forth in claim 1 wherein said element is in endwise abutting engagement with said connection end.

4. The pencil mechanism as set forth in claim 1 wherein said structure includes an annular nose bushing receiving said lead guide and coupled to the latter, said resilient member being of annular configuration and disposed about the exterior of said bushing for preventing rotational movement thereof.

5. The pencil mechanism as set forth in claim 4 wherein said member is tapered for allowing operative insertion of said bushing into said element without disruption and roll-up of the member.

6. The pencil mechanism as set forth in claim 1 wherein said lead moving means includes a lead gripper disposed within the bore of said guide for gripping the end of a lead segment, an elongated, axially rotatable, spiral element located around said guide and in operative engagement with said gripper for axial movement of the latter upon rotation of the spiral element.

* * * * *